US010816917B2

(12) United States Patent
Takami et al.

(10) Patent No.: US 10,816,917 B2
(45) Date of Patent: Oct. 27, 2020

(54) DEVELOPING APPARATUS

(71) Applicant: CANON KABUSHIKI KAISHA, Tokyo (JP)

(72) Inventors: Shota Takami, Kamagaya (JP); Takehiro Kojima, Tokyo (JP); Ryota Fujioka, Kashiwa (JP); Teppei Nagata, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/707,443

(22) Filed: Dec. 9, 2019

(65) Prior Publication Data

US 2020/0117121 A1 Apr. 16, 2020

Related U.S. Application Data

(63) Continuation of application No. PCT/JP2018/021770, filed on Jun. 6, 2018.

(30) Foreign Application Priority Data

Jun. 30, 2017 (JP) ..... 2017-129825

(51) Int. Cl.
*G03G 15/11* (2006.01)
*G03G 15/10* (2006.01)

(52) U.S. Cl.
CPC ..... *G03G 15/11* (2013.01); *G03G 15/104* (2013.01)

(58) Field of Classification Search
CPC ..... G03G 15/104; G03G 15/10; G03G 15/11; G03G 15/0815
See application file for complete search history.

(56) References Cited

U.S. PATENT DOCUMENTS 3,758,204 A * 9/1973 Mochizuki ..... G03G 15/101 399/245
8,200,125 B2 6/2012 Tabata et al.
(Continued)

FOREIGN PATENT DOCUMENTS

JP S53-105238 A 9/1978
JP 2005-017428 A 1/2005
(Continued)

OTHER PUBLICATIONS

PCT International Search Report dated Aug. 7, 2018, in PCT/JP2018/021770.

*Primary Examiner* — Walter L Lindsay, Jr.
*Assistant Examiner* — Jessica L Eley
(74) *Attorney, Agent, or Firm* — Venable LLP

(57) ABSTRACT

A developing apparatus includes a developer bearing member, a developer container, and a storage tank arranged within the developer container to store liquid developer to be supplied to the developer bearing member. The storage tank includes a first bottom surface including an inclined portion that is inclined downward with respect to a horizontal direction in a rotational axis direction of the developer bearing member, and a discharge port arranged on a lower end of the inclined portion of the first bottom surface. The developer container includes a second bottom surface including an inclined portion that is inclined downward with respect to the horizontal direction toward an opposite direction as the inclined portion of the first bottom surface in the rotational axis direction of the developer bearing member, and a discharge port arranged on a lower end of the inclined portion of the second bottom surface.

9 Claims, 6 Drawing Sheets

(56) References Cited

U.S. PATENT DOCUMENTS

| | | | | |
|---|---|---|---|---|
| 2005/0053398 | A1* | 3/2005 | Kim | G03G 15/11 399/237 |
| 2009/0080939 | A1 | 3/2009 | Sabo et al. | |
| 2012/0213542 | A1* | 8/2012 | Tsukada | G03G 15/11 399/71 |
| 2016/0209779 | A1* | 7/2016 | Komatsuzaki | G03G 15/105 |
| 2019/0391526 | A1 | 12/2019 | Nagata | |
| 2020/0019087 | A1 | 1/2020 | Fujioka et al. | |

FOREIGN PATENT DOCUMENTS

| | | | |
|---|---|---|---|
| JP | 2005-315947 | A | 11/2005 |
| JP | 2008-304606 | A | 12/2008 |
| JP | 2010-122342 | A | 6/2010 |
| JP | 2013-222209 | A | 10/2013 |

* cited by examiner

DEVELOPING APPARATUS

CROSS-REFERENCE TO RELATED APPLICATIONS

This application is a Continuation of International Patent Application No. PCT/JP2018/021770, filed Jun. 6, 2018, which claims the benefit of Japanese Patent Application No. 2017-129825, filed Jun. 30, 2017, both of which are hereby incorporated by reference herein in their entirety.

BACKGROUND OF THE INVENTION

Field of the Invention

The present invention relates to a developing apparatus for developing an electrostatic latent image formed on a photosensitive member into a toner image using liquid developer.

Description of the Related Art

Hitherto, a developing apparatus is known that develops electrostatic latent image formed on a charged photosensitive member into a toner image using liquid developer containing toner particles and liquid carrier (hereinafter referred to as carrier liquid). Liquid developer is supplied from a mixer to the developing apparatus and used for developing a toner image. In the developing apparatus, during image forming operation, liquid developer supplied from a mixer is borne on a rotating developing roller, and an electrostatic latent image formed on a photosensitive member is developed into a toner image by liquid developer borne on the developing roller. Toner in the liquid developer borne on the developing roller and not used for developing image is electrically collected from the developing roller by a cleaning roller, and thereafter, removed mechanically from the cleaning roller by a cleaning blade that slides against the cleaning roller.

Toner that had not been used for developing image is temporarily stored in a developer container together with liquid developer that had not been borne on the developing roller even though it had been supplied from the mixer, and thereafter, sent together with liquid developer from the developer container to the mixer and reused. However, liquid developer containing toner aggregates is not preferable since it may cause image defects. Toner aggregates may be caused by carrier liquid contained in the liquid developer remaining on the developing roller evaporating after the image forming operation had stopped.

As disclosed in Japanese Patent Application Laid-Open Publication No. 2010-122342, an image forming apparatus is proposed in which, after image forming operation is stopped, liquid developer remaining on the developing roller and the like is reduced by rotating the developing roller and the like for a predetermined period of time before stopping the rotation in a state where supply of liquid developer is stopped. Further, as disclosed in Japanese Patent Application Laid-Open Publication No. 2008-304606, an apparatus is proposed in which, after image forming operation is stopped, liquid developer is caused to flow into a developer container by its own weight, by arranging a developer supply blade that forms a developer pool together with a developing roller at a predetermined distance from the developing roller in a longitudinal direction thereof.

Toner aggregates may also be formed in a developer container that temporarily stores liquid developer. That is, according to the prior art apparatus as described above, for example, liquid developer having a high toner density is flown between the cleaning roller and the cleaning blade into the developer container and stored therein. Further, liquid developer that had not been used for developing image is stored in the developer container. Since liquid developer is not agitated in the developer container, toner contained in the liquid developer may precipitate and accumulate on a bottom surface of the developer container. In a state where supply of liquid developer from the mixer is stopped by the stopping of the image forming operation, liquid developer stored in the developer container is gradually discharged through the discharge port and reduced, so that the developer will be approximately empty. However, even in that state, a small amount of liquid developer may remain in the developer container, and the remaining liquid developer containing accumulated toner may have extremely high toner density, so that toner aggregates may be formed by the evaporation of carrier liquid thereafter.

SUMMARY OF THE INVENTION

According to one aspect of the present invention, a developing apparatus includes a developer bearing member configured to bear liquid developer including toner and carrier liquid and rotate, a developer container configured to collect and store liquid developer borne on the developer bearing member, and a storage tank arranged within the developer container and configured to store liquid developer to be supplied to the developer bearing member. The storage tank includes a first bottom surface including an inclined portion that is inclined downward with respect to a horizontal direction in a rotational axis direction of the developer bearing member, and a discharge port arranged on a lower end of the inclined portion of the first bottom surface and configured to discharge liquid developer by gravity into the developer container. The developer container includes a second bottom surface including an inclined portion that is inclined downward with respect to the horizontal direction toward an opposite direction as the inclined portion of the first bottom surface in the rotational axis direction of the developer bearing member, and a discharge port arranged on a lower end of the inclined portion of the second bottom surface and configured to discharge liquid developer to an exterior of the developer container.

Further features of the present invention will become apparent from the following description of exemplary embodiments with reference to the attached drawings.

DESCRIPTION OF THE EMBODIMENTS

First Embodiment

Figure 1:
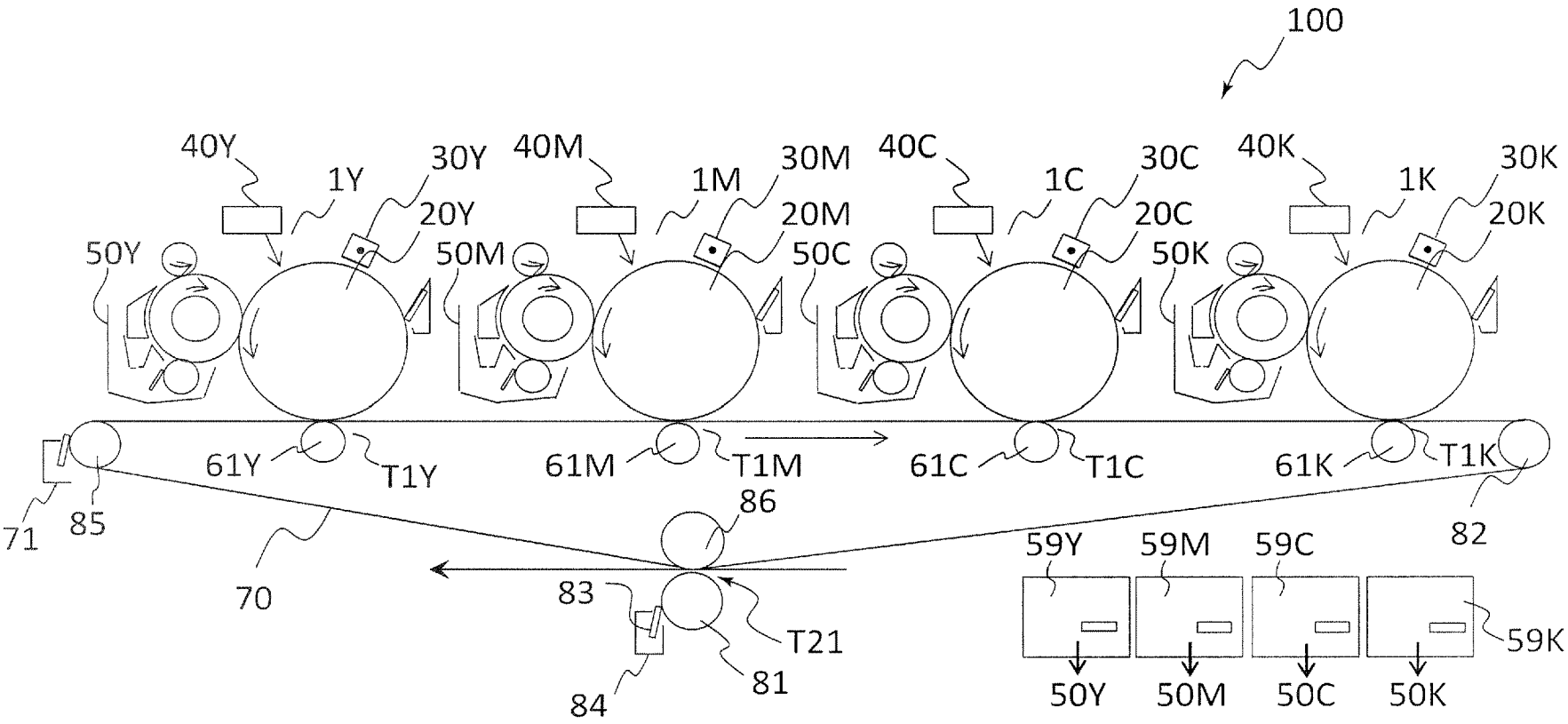
FIG. 1 is a schematic drawing illustrating a configuration of an image forming apparatus suitable for applying a developing apparatus according to the present embodiment.

A first embodiment will be described. First, an outline of an image forming apparatus preferable for adopting a developing apparatus according to the present embodiment will be described with reference to FIGS. 1 and 2. An image forming apparatus 100 according to FIG. 1 is a full-color printer adopting an electrophotographic system including four image forming units 1Y, 1M, 1C and 1K that correspond to four colors of yellow (Y), magenta (M), cyan (C) and black (K). In the present embodiment, a tandem-type system is adopted where the image forming units 1Y, 1M, 1C and 1K are arranged along a rotational direction of an intermediate transfer belt 70. The image forming apparatus 100 forms a toner image on a recording material according to an image signal from an external device (not shown) connected in a communicatable manner to an image forming apparatus body, for example. Sheet material such as paper, plastic film and cloth can be used as the recording material.

The respective image forming units 1Y, 1M, 1C and 1K form toner images of respective colors using liquid developer containing toner and carrier liquid on photosensitive members 20Y, 20M, 20C and 20K serving as image bearing members. Detailed descriptions of the image forming units will be described later.

The intermediate transfer belt 70 is an endless belt that is stretched across a driving roller 82, a driven roller 85 and a secondary transfer inner roller 86, and it is driven to rotate while abutting against the photosensitive members 20Y, 20M, 20C and 20K and a secondary transfer outer roller 81. Primary transfer rollers 61Y, 61M, 61C and 61K are respectively arranged at positions opposed to the photosensitive members 20Y, 20M, 20C and 20K interposing the intermediate transfer belt 70, by which primary transfer portions T1Y, T1M, T1C and T1K are formed. If a voltage of +200 V is applied to the primary transfer rollers 61Y, 61M, 61C and 61K, for example, toner images of four colors are sequentially superposed and transferred to the intermediate transfer belt 70 from the photosensitive members 20Y, 20M, 20C and 20K at the primary transfer portions T1Y, T1M, T1C and T1K. Thereby, a full-color toner image is formed on the intermediate transfer belt 70. It is also possible to form a toner image of a single color, such as black, to the intermediate transfer belt 70.

The secondary transfer outer roller 81 is arranged at a position opposed to the secondary transfer inner roller 86 with the intermediate transfer belt 70 interposed, forming a secondary transfer portion T21. A single-color toner image or a full-color toner image formed on the intermediate transfer belt 70 is transferred to the recording material at the secondary transfer portion T21. In the secondary transfer portion T21, the toner on the intermediate transfer belt 70 is secondarily transferred to the recording material by applying a voltage of +1000 V to the secondary transfer outer roller 81, for example, while maintaining the secondary transfer inner roller 86 to 0 V. The toner image transferred to the recording material is fixed to the recording material by a fixing unit not shown.

Liquid developer containing toner that had not been transferred to the recording material is removed from the intermediate transfer belt 70 by a cleaning device 71 having a blade that abuts against the intermediate transfer belt 70. A blade 83 is abutted against the secondary transfer outer roller 81, and liquid developer attached to the secondary transfer outer roller 81 is scraped by the blade 83 and collected by a two-roller collecting portion 84.

Image Forming Unit

The image forming units 1Y, 1M, 1C and 1K respectively include developing apparatuses 50Y, 50M, 50C and 50K. The developing apparatuses 50Y, 50M, 50C and 50K use liquid developer of respective colors containing toner of yellow, magenta, cyan and black to developer the electrostatic latent images formed on the photosensitive members 20Y, 20M, 20C and 20K into toner images.

The four image forming units 1Y, 1M, 1C and 1K adopt a similar configuration, except for the difference in the colors of the images being developed. Therefore, the image forming unit 1K is described as an example, and description of other image forming units 1Y, 1M and 1C are omitted.

Figure 2:
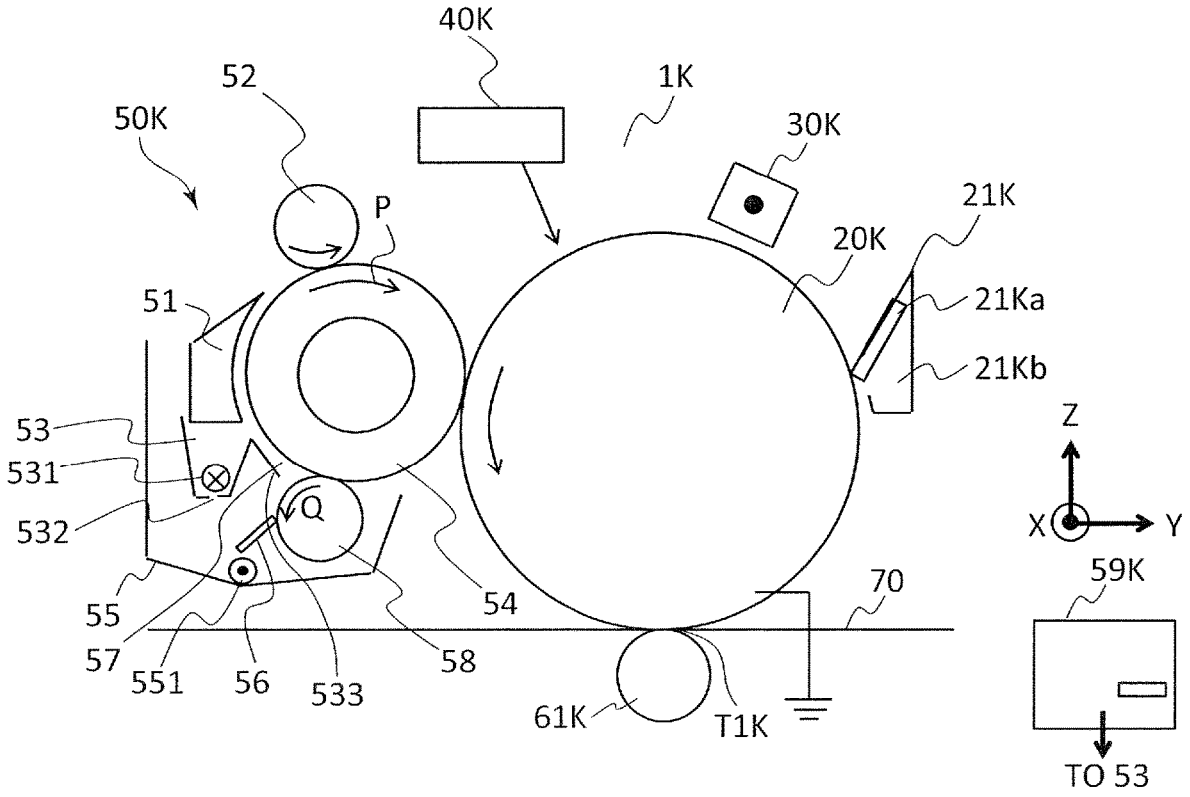
FIG. 2 is a cross-sectional view illustrating a configuration of an image forming unit.

As illustrated in FIG. 2, a charging device 30K configured to charge a photosensitive member 20K, an exposing unit 40K for forming an electrostatic latent image on the photosensitive member 20K being charged, a developing apparatus 50K, a cleaning device 21K and so on are arranged around the photosensitive member 20K along a direction of rotation thereof.

The photosensitive member 20K is a photosensitive drum formed in a cylindrical shape, including a cylindrical base material and a photosensitive layer formed on an outer circumferential surface thereof, and which is rotatable around a center shaft. The photosensitive layer is formed of an organic photosensitive member or an amorphous silicon photosensitive member and the like. According to the present embodiment, the photosensitive member 20K rotates in a counterclockwise direction, as illustrated by the arrow in FIG. 2. Further, the photosensitive member 20K is formed so that a length thereof in a rotational axis direction, that is, longitudinal direction, is longer than a length of a developing roller 54 described later in a rotational axis direction, that is, longitudinal direction.

The charging device 30K is a device that charges the photosensitive member 20K which is a corona charger, for example. The charging device 30K is provided upstream of a nip portion between the photosensitive member 20K and the developing roller 54 described later, and by charging a voltage having a same polarity as toner from a power supply not shown, the surface of the photosensitive member 20K is charged to predetermined potential (−500 V, for example, in a non-image area). The exposing unit 40K includes a semiconductor laser, a polygon mirror, an F-θ lens and the like, and irradiates laser modulated according to the image signal to the photosensitive member 20K in the charged state to thereby form an electrostatic latent image (−100 V, for example, in an image area) on the photosensitive member 20K.

The developing apparatus 50K is an apparatus for developing the electrostatic latent image formed on the photosensitive member 20K as toner image using black toner. The developing apparatus 50K will be described in detail later (refer to FIGS. 2 and 3B). The toner image developed on the photosensitive member 20K by the developing apparatus 50K is primarily transferred to the intermediate transfer belt 70 by having a voltage of opposite polarity (+200 V) as the charging characteristics of toner applied to a primary transfer roller 61K. Carrier liquid and a small amount of toner of approximately a few % remains on the photosensitive member 20K after primary transfer, but the liquid developer containing the same is collected by the cleaning device 21K arranged downstream of a primary transfer portion T1K in the direction of rotation. The cleaning device 21K includes a cleaning blade 21Ka and a drum collecting portion 21Kb, and collects the liquid developer remaining on the photosensitive member 20K after primary transfer.

Developing Apparatus

As illustrated in FIG. 2, the developing apparatus 50K includes the developing roller 54 serving as a developer bearing member that bears liquid developer and supplies the same to the photosensitive member 20K. A developer storage tank 53, a film forming electrode 51, a squeeze roller 52 serving as a squeeze member, and a cleaning roller 58 serving as a collecting member are arranged around the developing roller 54. The developer storage tank 53, the film forming electrode 51, the squeeze roller 52 and the cleaning roller 58 are arranged in a developer container 55 that also serves as a developer collecting tank.

Voltage is applied respectively from a power supply not shown to the developing roller 54, the film forming electrode 51, the squeeze roller 52 and the cleaning roller 58. According to the potential difference of voltages applied respectively thereto, toner in the liquid developer is moved within the solution layer to a predetermined direction by electrophoresis. In the present embodiment, voltages applied respectively to the developing roller 54, the film forming electrode 51, the squeeze roller 52 and the cleaning roller 58 are all negative voltage. Specifically, according to the present embodiment, voltages of −300 V, −500 V to −900 V, −350 V to −420 V, and −150 V are respectively applied to the developing roller 54, the film forming electrode 51, the squeeze roller 52 and the cleaning roller 58 during image forming operation.

The developing roller 54 rotates while bearing liquid developer containing toner and carrier liquid, and develops the electrostatic latent image formed on the photosensitive member 20K by toner at a developing position opposed to the photosensitive member 20K. The developer container 55 has one part opposed to the photosensitive member 20K opened, and the developing roller 54 is rotatably disposed on the developer container 55 so that a portion thereof is exposed through the opening portion. The developing roller 54 is a cylindrical member having a diameter of 45 mm, for example, and it rotates clockwise around a center shaft, as illustrated by arrow P in FIG. 2. The developing roller 54 includes an elastic layer such as a conductive polymer having a thickness of 5 mm disposed on an outer circumference portion of an inner core made of metal such as stainless steel.

Voltage (−300 V) is applied to the developing roller 54 from a power supply not shown, and according to an electric field formed between the photosensitive member 20K by the applied voltage, toner is moved by electrophoresis onto the photosensitive member 20K at the image area (−100 V). Meanwhile, in the non-image area (−500 V), electric field operates in a direction to press toner against the developing roller 54, so that toner remains on the developing roller 54. Thereby, toner image is formed on the photosensitive member 20K. Carrier liquid is not influenced by the electric field, so that carrier liquid is divided into approximately the same amounts between the developing roller 54 and the photosensitive member 20K and is corotated therewith.

The developer storage tank 53 can temporarily store liquid developer having black toner dispersed in carrier liquid. Further, the developer storage tank 53 is capable of supplying stored liquid developer to the developing roller 54. That is, the developer storage tank 53 stores liquid developer for developing the electrostatic latent image formed on the photosensitive member 20K to be supplied to the developing roller 54. According to the present embodiment, the developer storage tank 53 can store approximately 500 ml of liquid developer. Liquid developer used in the present embodiment is formed by adding particles having an average particle diameter of 0.8 μm in which coloring agents such as pigments are dispersed mainly in polyester-based resin to carrier liquid such as organic solvent, together with dispersing agent, toner charge control agent and charge directing agent. The toner surface is charged negatively to a certain value.

Liquid developer stored in the developer storage tank 53 is supplied from a mixer 59K. The mixer 59K agitates and mixes carrier liquid supplied from a carrier tank not shown and liquid developer for replenishment having a high toner density (such as 45 wt %) replenished from a developer tank not shown and adjusts the toner density of liquid developer supplied to the developer storage tank 53.

A developer supply port 531 for connecting to the mixer 59K is formed on the developer storage tank 53, and liquid developer adjusted to a toner density of approximately 3.5±0.5 wt % is supplied from the mixer 59K at a flow rate of approximately 4.24 L/min or greater to the developer storage tank 53. Meanwhile, liquid developer stored in the developer container 55 is returned to the mixer 59K as described later. A discharge port 551 is formed on the developer container 55 for discharging the liquid developer stored in the developer container 55 to the exterior of the developer container 55. Thus, liquid developer is circulated between the developing apparatus 50K and the mixer 59K.

A guide member 533 that forms a flushing flow path 57 and a discharge port 532 through which stored liquid developer is discharged by gravity into the developer container 55 are formed on the developer storage tank 53. A part of liquid developer supplied from the mixer 59K to the developer storage tank 53 is guided by the guide member 533 to flow between a nip portion of the developing roller 54 and the cleaning roller 58 described later, which is so-called flushing. Meanwhile, a part of liquid developer stored in the developer storage tank 53 is discharged through the discharge port 532 formed on the bottom surface of the developer storage tank 53. The liquid developer in the developer storage tank 53 is guided by the guide member 533 at a flow rate of approximately 0.57 L/min, for example, and discharged through the discharge port 532 at a flow rate of approximately 0.3 L/min. Liquid developer guided by the guide member 533 or liquid developer discharged from the discharge port 532 is stored in the developer container 55. When supply of liquid developer from the mixer 59K to the developer storage tank 53 is stopped when the image forming operation has stopped, the amount of liquid developer stored in the developer storage tank 53 is gradually reduced, and finally, the developer storage tank 53 becomes approximately empty.

The film forming electrode 51 is arranged to oppose to the developing roller 54 with a predetermined gap formed therebetween at a position upstream of the developing position with respect to the direction of rotation of the developing roller 54. The film forming electrode 51 is formed so that its circumferential length of a surface opposed to the developing roller 54 is 24 mm, and a gap of 400±40 μm is formed between the developing roller 54. If such gap is formed, a part of liquid developer supplied to the developer storage tank 53 is drawn up by the gap at a flow rate of approximately 3.37 L/min by the rotation of the developing roller 54. When voltage (−500 V to −900 V) is applied from a power supply not shown to the film forming electrode 51, toner is drawn toward the developing roller 54 by electric field that occurs by the difference between film forming voltage and voltage (−300 V) applied to the developing roller 54. As described, the film forming electrode 51 forms a film of liquid developer supplied from the developer storage tank 53 on the developing roller 54 and moves the toner by the operation of the electric field toward the developing roller 54, that is, toward the developer bearing member. Liquid developer that had not been drawn up in the gap from the developer storage tank 53 drops into the developer container 55 and is stored therein.

The squeeze roller 52 is arranged downstream of the film forming electrode 51 and upstream of the developing position with respect to the direction of rotation of the developing roller 54, and toner in the liquid developer formed as a film on the developing roller 54 is pressed against the developing roller 54. That is, if voltage (−350 to −420 V) is applied from a power supply not shown, the squeeze roller 52 draws toner contained in the liquid developer formed as a film on the developing roller 54 by electric field toward the developing roller 54, and at the same time, squeezes and collects excessive liquid developer, mainly carrier liquid. Liquid developer collected by the squeeze roller 52 flows into the developer container 55 and is stored therein. A fixed amount of liquid developer drawn up from the developer storage tank 53 and passed through the film forming electrode 51 is borne on the developing roller 54 by the squeeze roller 52. After passing the squeeze roller 52, the toner density of liquid developer borne on the developing roller 54 is adjusted to higher density (40±5 wt %, for example) than the toner density of liquid developer in the developer storage tank 53.

The squeeze roller 52 described above is a cylindrical member made of metal, and in the present embodiment, a roller formed of stainless steel and having a diameter of 16 mm is used. The squeeze roller 52 is abutted against the developing roller 54 with a constant pressure (such as 80±5 kPa) over the whole longitudinal direction of the developing roller 54, that is, the rotational axis direction of the developing roller 54 (such as 354 mm). The squeeze roller 52 rotates in a counterclockwise direction, as illustrated in FIG. 2.

The cleaning roller 58 electrically collects toner on the developing roller 54 that has not been used for developing image by the operation of the electric field. The cleaning roller 58 abuts against the surface of the developing roller 54 at a collecting position that is positioned downstream of the developing position in the direction of rotation of the developing roller 54, and toner remaining on the developing roller 54 after developing image is cleaned by applying voltage (−150 V) from a power supply not shown. The cleaning roller 58 is a metal roller formed of stainless steel or aluminum, for example, and it rotates in a counterclockwise direction shown by arrow Q in FIG. 2.

Toner collected by the cleaning roller 58 is removed by a cleaning blade 56 serving as a removing member. The cleaning blade 56 is a plate member formed of metal such as stainless steel, and abuts against the cleaning roller 58 at a position downstream of the collecting position with respect to the direction of rotation of the cleaning roller 58. The cleaning blade 56 removes toner from the cleaning roller 58. Toner removed by the cleaning blade 56 flows down into the developer container 55 and is stored therein partially by liquid developer collected by the squeeze roller 52 and partially by liquid developer guided by the guide member 533. For example, the toner density of liquid developer at the abutment position of the cleaning blade 56 is approximately 60 wt %, and the toner density of liquid developer that flows into the developer container 55 as described above is approximately 30 wt %.

The developing roller 54, the squeeze roller 52 and the cleaning roller 58 are rotated at approximately the same peripheral speed during image forming operation. The driving force of rotation is provided to the developing roller 54 from a drive motor not shown, and driving force is shared from the developing roller 54 to the squeeze roller 52 and the cleaning roller 58 by a gear train not shown. Therefore, according to the present embodiment, in a state where the image forming operation is started and stopped, the rotational movement of the three rollers will start and stop simultaneously.

After having paper dust and toner removed by a separator not shown, liquid developer collected by the drum collecting portion 21Kb, the two-roller collecting portion 84 and the cleaning device 71 (refer to FIG. 1) is merged with liquid developer discharged from the developer container 55 and returned to the mixer 59K.

As described, according to the developing apparatus 50K, the discharge port 532 is formed on the developer storage tank 53, and liquid developer is discharged therethrough to the exterior of the developer storage tank 53. Further, the discharge port 551 is formed on the developer container 55, and liquid developer is discharged therethrough to the exterior of the developer container 55. This is to leave as little liquid developer as possible in the developer storage tank 53 and the developer container 55 when supply of liquid developer from the mixer 59K to the developer storage tank 53 is stopped.

However, merely forming the discharge port 532 and the discharge port 551 as in the conventional arrangement lead to drawbacks where carrier liquid was evaporated from the liquid developer remaining in the developer storage tank 53 and the developer container 55 and toner tended to aggregate, as described earlier. However, it could be said that toner is not easily aggregated in the developer storage tank 53 since liquid developer having a relatively low toner density supplied from the mixer 59K only remains in the developer storage tank 53. Meanwhile, liquid developer collected by the squeeze roller 52 and liquid developer containing toner removed by the cleaning blade 56 is stored in the developer container 55, and the toner density thereof is higher than liquid developer supplied from the mixer 59K. Since liquid developer is not agitated in the developer container 55, toner tends to accumulate in the developer container 55. Therefore, the toner density of liquid developer remaining in the developer container 55 after supply of liquid developer has been stopped becomes high, and toner tends to aggregate by evaporation of carrier liquid in the developer container 55 than in the developer storage tank 53.

Regarding the above, according to the present embodiment, in addition to reducing the amount of liquid developer remaining in the developer storage tank 53 as much as possible after stopping supply of liquid developer, the toner density of liquid developer remaining in the developer container 55 is also reduced as much as possible. The developing apparatus 50K according to the first embodiment will be described with reference to FIGS. 3A and 3B. In the following description, the developing apparatus 50K is described as an example, and the descriptions of the developing apparatuses 50Y, 50M and 50C, which have a similar configuration, are omitted.

Figure 3A:
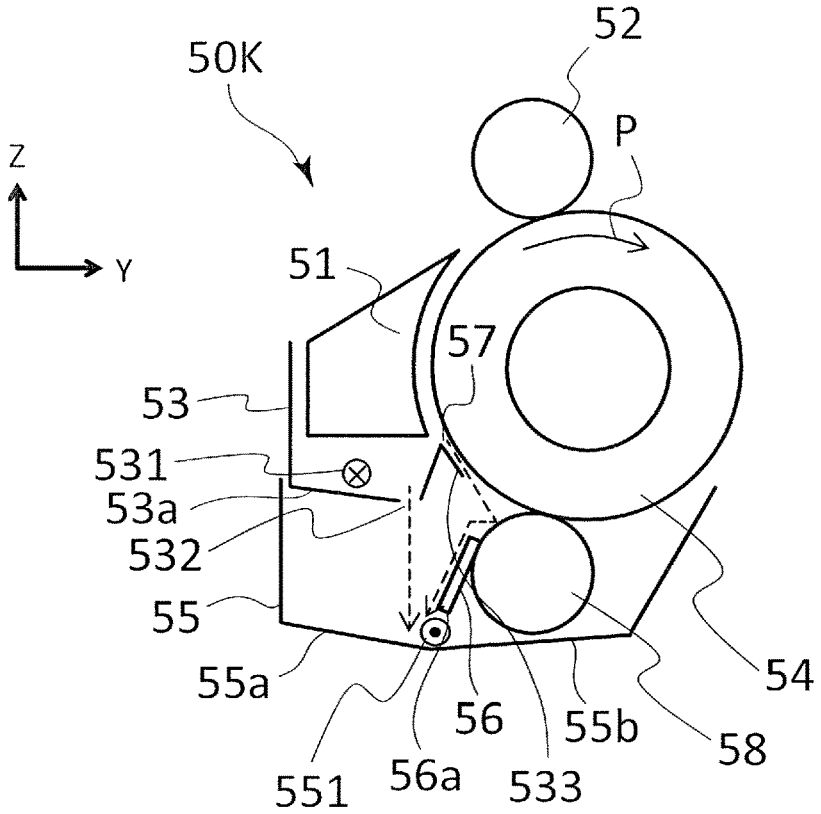
FIG. 3A is a schematic diagram illustrating a developing apparatus according to a first embodiment in a rotational axis direction.

As illustrated in FIG. 3A, according to the developing apparatus 50K of the present embodiment, a bottom surface (55*a*, 55*b*) of the developer container 55 is inclined in a width direction, i.e., direction Y in the drawing, orthogonal to the rotational axis direction of the developing roller 54. In detail, the developer container 55 includes a bottom surface 55*a* serving as a second bottom surface that is inclined downward with respect to the horizontal direction from one end of the developer container 55 toward a center portion with respect to the width direction orthogonal to the rotational axis direction of the developing roller 54. It further includes a bottom surface 55*b* that is inclined downward with respect to a horizontal direction from the other end of the developer container 55 toward a center portion. In this case, the bottom surface of the developer container 55 is formed in a substantially V-shape by the bottom surface 55*a* and the bottom surface 55*b*, so that the liquid developer in the developer container 55 is easily gathered at an approximately V-shaped valley portion along the bottom surface 55*a* and the bottom surface 55*b* by gravity. Therefore, the discharge port 551 described above is formed to have an approximately V-shaped valley portion.

Further according to the present embodiment, the position at which the liquid developer flowing along the cleaning blade 56 falls down into the developer container 55 and the position of the approximately V-shaped valley portion formed by the bottom surface 55*a* and the bottom surface 55*b* approximately correspond in the width direction. The cleaning blade 56 should be arranged such that a leading edge portion 56*a* of a side opposite to the side abutted against the cleaning roller 58 is positioned between the discharge port 532 and the discharge port 551 in the width direction. Thereby, during image forming operation, toner contained in the liquid developer flowing along the cleaning blade 56, especially toner removed from the cleaning roller 58, tends to be gathered at the approximately V-shaped valley portion in the developer container 55. Further, the cleaning blade 56 should be arranged such that the leading edge portion 56*a* is positioned between the discharge port 551 and the discharge port 532 when viewed in the vertical direction.

Figure 3B:
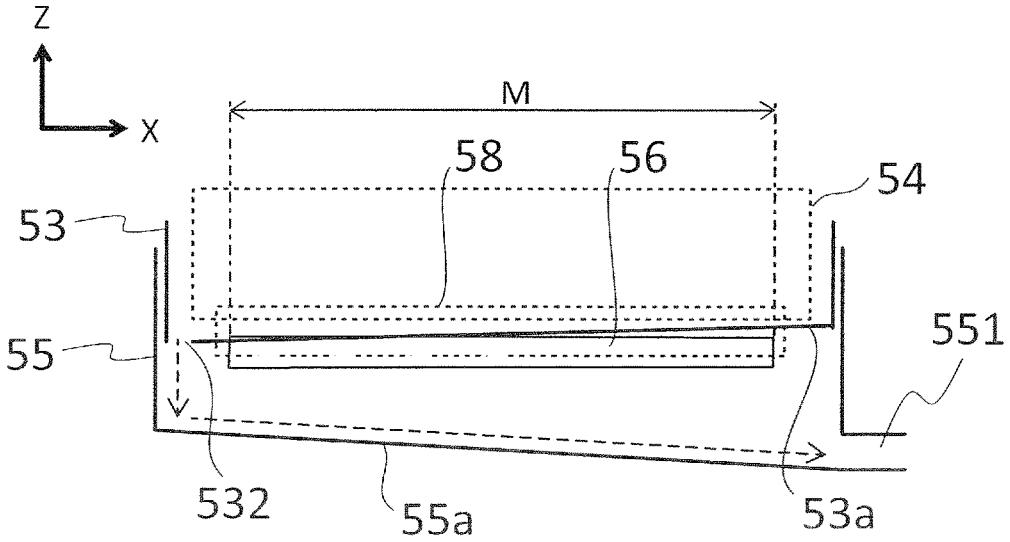
FIG. 3B is a schematic diagram illustrating the developing apparatus according to the first embodiment in a direction orthogonal to the rotational axis direction.

As illustrated in FIG. 3B, according to the developing apparatus 50K of the present embodiment, a bottom surface 53*a* of the developer storage tank 53 is inclined in the rotational axis direction, i.e., direction X in the drawing, of the developing roller 54. In detail, the bottom surface 53*a* serving as a first bottom surface includes an inclined portion that is inclined approximately across the whole area from one end to the other end of the developer storage tank 53 downward toward the horizontal direction in the rotational axis direction of the developing roller 54. Therefore, the liquid developer in the developer storage tank 53 is flown from one end toward the other end by gravity. In the present embodiment, an inclination angle of the bottom surface 53*a* should be set to an angle (such as 1.1°) determined based on a sufficient inclination angle (such as 0.5°) for flowing liquid developer having a viscosity of 30 cP, which corresponds to approximately 35 wt % toner density, plus tolerance. The above-described discharge port 532 is formed on the lower end of the bottom surface 53*a*, that is, left end in FIG. 3B. Liquid developer in the developer storage tank 53 has a toner density of approximately 4%, so that the liquid developer sufficiently flows toward the discharge port 532 along the bottom surface 53*a* having the inclination angle described above.

Figure 4:
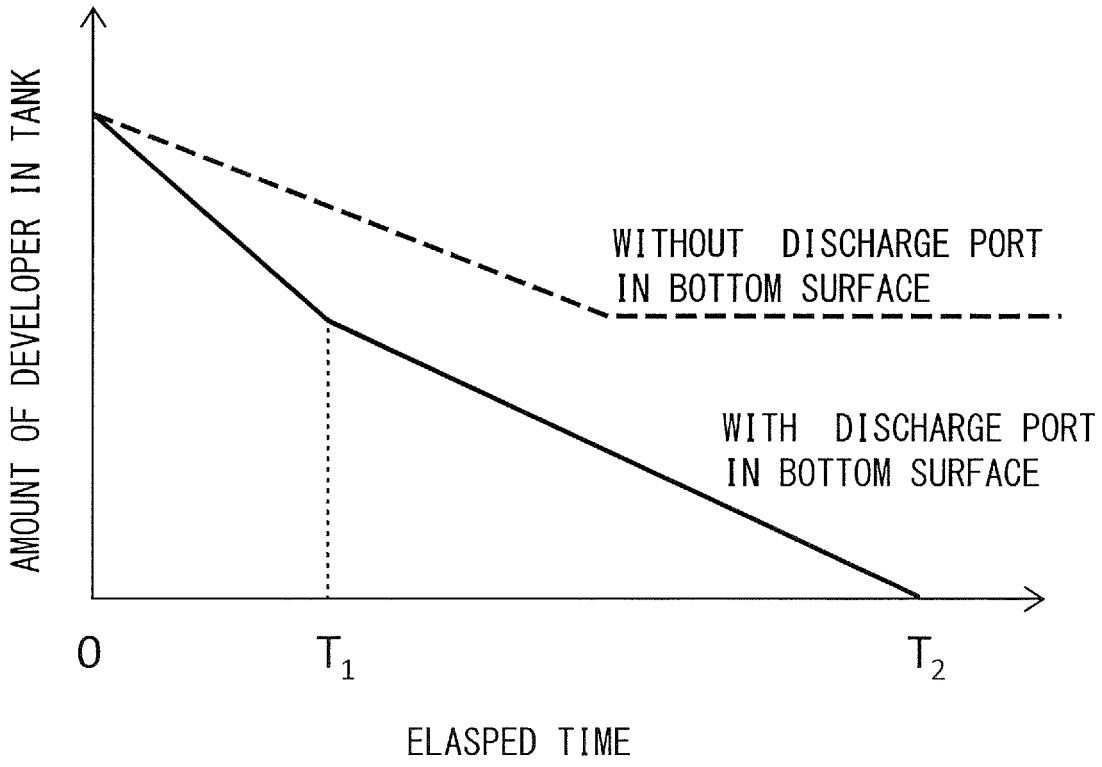
FIG. 4 is a graph illustrating a transition by time of an amount of liquid developer within a developer storage tank after the image forming operation has stopped.

FIG. 4 illustrates a transition by time of the amount of liquid developer stored in the developer storage tank 53 after image formation operation has been stopped of cases where the discharge port 532 is either formed or not formed on the developer storage tank 53. In FIG. 4, a case where the discharge port 532 is formed is illustrated by a solid line, and a case where the discharge port 532 is not formed is illustrated by a dotted line. As can be recognized from FIG. 4, if the discharge port 532 is not formed on the developer storage tank 53, the amount of liquid developer in the developer storage tank 53 is maintained to a fixed amount after a predetermined time has elapsed. Meanwhile, if the discharge port 532 is formed on the developer storage tank 53, most of the liquid developer in the developer storage tank 53 is discharged into the developer container 55 (refer to time T2). The discharge amount of liquid developer differs between the period from the stopping of image forming operation (time 0) to elapse of time T1 and the period from time T1 to time T2, since the above-described flushing is performed until time T1 has elapsed. According to the present embodiment, almost all the liquid developer in the developer storage tank 53 can be discharged after elapse of a certain time (T2 of FIG. 4: approximately 100 seconds) by inclining the bottom surface 53*a* of the developer storage tank 53 and forming the discharge port 532 at an area where the height of the bottom surface 53*a* is lowest.

As illustrated in FIG. 3B, according to the developing apparatus 50K of the present embodiment, the bottom surface 55*a* of the developer container 55 is inclined in the rotational axis direction of the developing roller 54. In further detail, the bottom surface 55*a* of the developer container 55 includes an inclined portion that is included from one end to the other end of the developer container 55 at a portion overlapped with the bottom surface 53*a* of the developer storage tank 53 when viewed in the vertical direction and inclined in an opposite direction as the bottom surface 53*a* with respect to the horizontal direction in the rotational axis direction of the developing roller 54. According to the present embodiment, the inclination angle of the bottom surface 55*a* should be set to an angle (such as 1.1°) determined based on a sufficient inclination angle (such as 0.5°) for flowing liquid developer having a viscosity of 30 cP, plus tolerance. However, since the toner density of liquid developer in the developer container 55 tends to be higher than that of liquid developer in the developer storage tank 53, the inclination angle of the bottom surface 55*a* should preferably be higher than the inclination angle of the bottom surface 53*a*. Further, the above-described discharge port 551 is formed at a lower end of the bottom surface 55*a* (right end of FIG. 3B). In the present embodiment, the discharge port 551 is formed on a side wall of the developer container 55 at a lower end edge of the bottom surface 55*a*.

According to the present embodiment, the discharge port 532 and the discharge port 551 are arranged outside an abutment area M where the cleaning blade 56 abuts against the cleaning roller 58 in the rotational axis direction, i.e. direction X in the drawing, of the developing roller 54. That is, the position where liquid developer flows down along the cleaning blade 56 in the developer container 55 is the abutment area M between the cleaning blade 56 and the cleaning roller 58 with respect to the rotational axis direction of the developing roller 54. Therefore, in order to allow liquid developer discharged from the discharge port 532 to flow across the whole abutment area M in the developer container 55, the discharge port 532 and the discharge port 551 are formed at the above-described positions distant from one another and interposing the abutment area M.

In the present embodiment, liquid developer in the developer storage tank 53 is discharged at a flow rate of approximately 0.3 L/min through the discharge port 532 as described above. Meanwhile, liquid developer in the developer container 55 is discharged at a flow rate of approximately 0.5 L/min from the discharge port 551. In other words, the amount of liquid developer discharged from the developer container 55 through the discharge port 551 is greater than the amount of liquid developer discharged from the developer storage tank 53 through the discharge port 532. The opening area of the discharge port 532 is formed smaller than the opening area of the discharge port 551. Thereby, in a state where supply of liquid developer from the mixer 59K is stopped, the amount of reduction of liquid developer in the developer container 55 exceeds the amount of reduction of liquid developer in the developer storage tank 53. Therefore, after a certain time has elapsed from the stopping of supply of liquid developer from the mixer 59K, liquid developer discharged from the developer storage tank 53 is discharged through the discharged port 551 along the bottom surface 55*a*, in further detail, the approximately V-shaped valley portion, of the developer container 55. Thereby, in a state where toner is accumulated on the bottom surface 55*a* of the developer container 55 during image forming operation, the toner is washed away by the liquid developer discharged from the developer storage tank 53. Accordingly, even if liquid developer remains in the developer container 55, the toner density is sufficiently reduced compared to the prior art.

If the period of time for washing the bottom surface 55*a* of the developer container 55 using the liquid developer discharged from the developer storage tank 53 is too short, the toner accumulated on the bottom surface 55*a* of the developer container 55 may not be sufficiently removed. Therefore, the present inventors have confirmed through experiment the length of time during which liquid developer should be discharged from the developer storage tank 53 to sufficiently remove the toner accumulated on the bottom surface 55*a* of the developer container 55. In the experiment, the time during which liquid developer having a toner density of 4 wt % is flown from the developer storage tank 53 to the developer container 55 was varied, and thereafter, the amount of toner remaining on the bottom surface 55*a* of the developer container 55 was confirmed. The result of the experiment is illustrated in Table 1 below. In Table 1, a case where toner always remained on the bottom surface 55*a* of the developer container 55 was evaluated as "poor", a case where toner sometimes remained and sometimes not remained on the bottom surface 55*a* of the developer container 55 was evaluated as "average", and a case where almost no toner remained on the bottom surface 55*a* of the developer container 55 was evaluated as "good".

TABLE 1

| TIME DURING WHICH LIQUID DEVELOPER IS FLOWN (SEC) | AMOUNT OF TONER REMAINING ON BOTTOM SURFACE OF DEVELOPER CONTAINER |
|---|---|
| 0 | POOR |
| 20 | AVERAGE |
| 40 | GOOD |
| 60 | GOOD |
| 80 | GOOD |
| 100 | GOOD |

As can be recognized from Table 1, toner always remained on the bottom surface 55*a* of the developer container 55 if the length of time was shorter than 20 seconds. Toner sometimes remained and sometimes not remained on the bottom surface 55*a* of the developer container 55 if the time was 20 seconds or longer and shorter than 40 seconds. Almost no toner remained on the bottom surface 55*a* of the developer container 55 if the time was 40 seconds or longer. According to the present embodiment, as described earlier, the developer storage tank 53 can store approximately 500 ml of liquid developer, and liquid developer can be discharged at a flow rate of approximately 0.3 L/min from the developer storage tank 53, so that it takes approximately 100 seconds for liquid developer to be discharged from the developer storage tank 53. In other words, the present embodiment enables liquid developer to be flown in the developer container 55 for approximately 100 seconds, allowing toner remaining on the bottom surface 55*a* of the developer container 55 to be sufficiently removed.

As described, according to the developing apparatus 50K, the bottom surface 53*a* of the developer storage tank 53 and the bottom surface 55*a* of the developer container 55 are formed to be inclined downward in mutually opposite directions in the rotational axis direction, i.e., direction X in the drawing, of the developing roller 54. The discharge port 532 and the discharge port 551 through which liquid developer is discharged are formed on the bottom surface 53*a* of the developer storage tank 53 and the bottom surface 55*a* of the developer container 55 at the lowest areas in the vertical direction interposing the abutment area M between the cleaning blade 56 and the cleaning roller 58. Thereby, liquid developer in the developer storage tank 53 is discharged from the discharge port 532 by gravity according to the inclination of the bottom surface 53*a* and flows down to the higher side in the vertical direction of the inclined bottom surface 55*a* of the developer container 55. In the developer container 55, liquid developer is flown along the inclination of the bottom surface 55*a* by gravity toward the discharge port 551. The discharge port 532 and the discharge port 551 are arranged interposing the abutment area M between the cleaning blade 56 and the cleaning roller 58, so that toner accumulated on the bottom surface 55*a* of the developer container 55 can be washed away by liquid developer discharged through the discharge port 532. If accumulated toner can be washed away, even if liquid developer remains in the developer container 55, the toner density thereof is sufficiently reduced. As described, the present embodiment enables to reduce toner density of liquid developer remaining in the developer container 55 by a simple configuration after the supply of liquid developer has stopped, to thereby suppress image defects caused by toner accumulated in the developer container 55.

Second Embodiment

A second embodiment will be described with reference to FIG. 5. The first embodiment described above (refer to FIGS. 3A and 3B) adopts a configuration where the bottom surface 53*a* of the developer storage tank 53 is inclined from one end to the other end of the developer storage tank 53, and the bottom surface 55*a* of the developer container 55 is inclined from one end to the other end of the developer container 55. In contrast, the second embodiment adopts a configuration where a bottom surface of a developer storage tank 53A and a bottom surface of a developer container 55A differ from the first embodiment. The other configurations and effects are similar to the first embodiment. Therefore, in the following description, configurations similar to the first embodiment are denoted with the same reference numbers and descriptions thereof are either omitted or simplified, and the configurations that differ from the first embodiment are mainly described.

Figure 5:
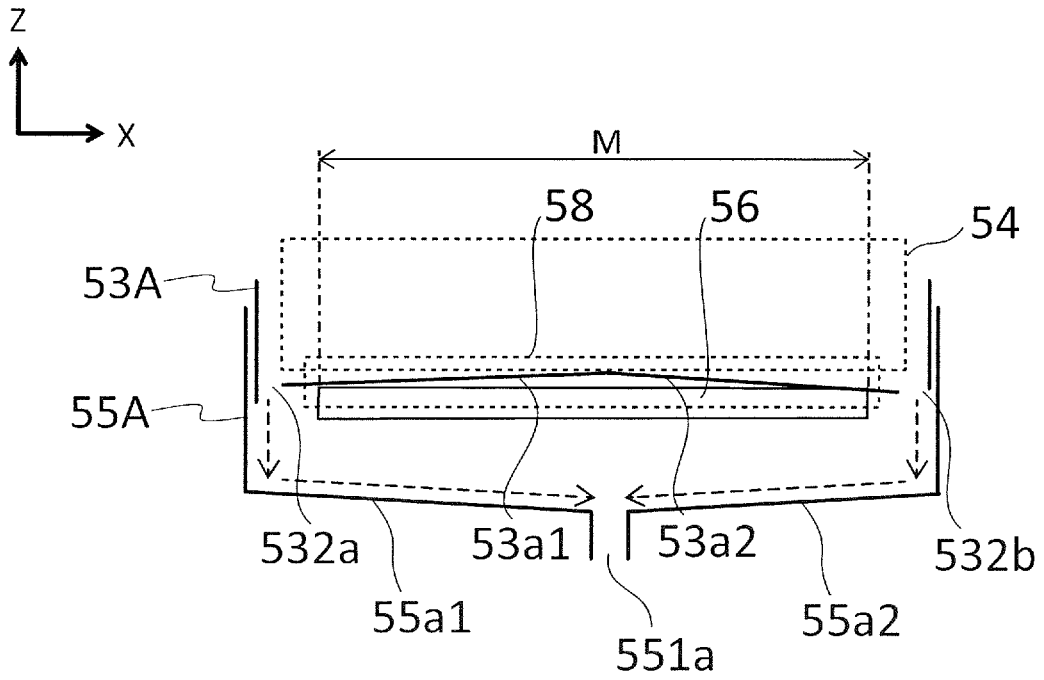
FIG. 5 is a schematic diagram illustrating a developing apparatus according to a second embodiment in a direction orthogonal to the rotational axis direction.

As illustrated in FIG. 5, a bottom surface of the developer storage tank 53A includes a first inclined surface 53*a*1 serving as a first inclined portion that is inclined downward from a center portion of the developer storage tank 53A (first bottom surface 53*a*) toward one end portion of the bottom surface 53*a* in the rotational axis direction, i.e., direction X in the drawing, of the developing roller 54. It further includes a third inclined surface 53*a*2 serving as a third inclined portion that is inclined downward from a center portion of the developer storage tank 53A (first bottom surface 53*a*) toward the other end portion. In this case, the bottom surface of the developer storage tank 53A is formed in an inverted V-shape by the first inclined surface 53*a*1 and the third inclined surface 53*a*2, so that liquid developer in the developer storage tank 53A is flown by gravity from the center portion towards both ends of the developer storage tank 53A. Therefore, according to the present embodiment, a first discharge port 532*a* and a third discharge port 532*b* are formed on either ends of the developer storage tank 53A.

Meanwhile, the bottom surface of the developer container 55A includes a second inclined surface 55*a*1 serving as a second inclined portion that overlaps with the first inclined surface 53*a*1 when viewed in the vertical direction in the rotational axis direction, i.e., direction X in the drawing, of the developing roller 54 and a fourth inclined surface 55*a*2 serving as a fourth inclined portion that overlaps with the third inclined surface 53*a*2. That is, the second inclined surface 55*a*1 is inclined downward from one of end portions of the developer container 55A toward the center portion, and the fourth inclined surface 55*a*2 is inclined downward from the other one of the end portions of the developer container 55A toward the center portion. In this case, the bottom surface of the developer container 55A is formed in an approximately V-shape by the second inclined surface 55*a*1 and the fourth inclined surface 55*a*2, so that liquid developer in the developer container 55A is easily gathered by gravity to the center portion which is an approximately V-shaped valley portion along the second inclined surface 55*a*1 and the fourth inclined surface 55*a*2. Thereby, a second discharge port 551*a* serving as a discharge port of the developer container 55A is formed at the approximately V-shaped valley portion.

Further according to the present embodiment, the first discharge port 532*a* and the third discharge port 532*b* serving as discharge ports of the developer storage tank 53A are formed on the outer side of the abutment area M between the cleaning blade 56 and the cleaning roller 58 in the rotational axis direction, i.e., direction X in the drawing, of the developing roller 54. Further, the amount of discharge of liquid developer from the first discharge port 532*a* and the third discharge port 532*b* is set to be approximately 0.3 L/min in total. The inclination angle of the respective first, second, third and fourth inclined surfaces mentioned above should be set to an angle (such as 1.1°) determined based on a sufficient inclination angle (such as 0.5°) for flowing liquid developer having a viscosity of 30 cP, plus tolerance.

As described, according to the second embodiment, liquid developer discharged from the first discharge port 532*a* and the third discharge port 532*b* formed on both ends of the developer storage tank 53A is flown toward the second discharge port 551*a* formed at the center portion which is an approximately V-shaped valley portion along the inclination in the developer container 55A. Similarly, according to the present embodiment, the first discharge port 532*a* and the third discharge port 532*b* are formed to interpose the abutment area M between the cleaning blade 56 and the cleaning roller 58 with the second discharge port 551*a*. Therefore, liquid developer discharged through the first discharge port 532*a* and the third discharge port 532*b* washes away toner accumulated on the bottom surface (55*a*1 and 55*a*2) of the developer container 55A. Therefore, even according to the second embodiment, a similar effect as the first embodiment of reducing the toner density of liquid developer remaining in the developer container 55A after stopping supply of liquid developer can be achieved by a simple configuration.

Third Embodiment

A third embodiment will be described with reference to FIG. 6. According to the second embodiment described above (refer to FIG. 5), a configuration in which the bottom surface of the developer storage tank 53A is formed in an inverted V-shape by the first inclined surface 53*a*1 and the third inclined surface 53*a*2 was described. The third embodiment differs from the second embodiment in that the directions of inclination of the first inclined surface 53*a*1 and the third inclined surface 53*a*2 are opposite. The other configurations and effects are similar to the second embodiment. Therefore, in the following description, configurations similar to the second embodiment are denoted with the same reference numbers and the descriptions thereof are either omitted or simplified, and the configurations that differ from the first embodiment are mainly described.

Figure 6:
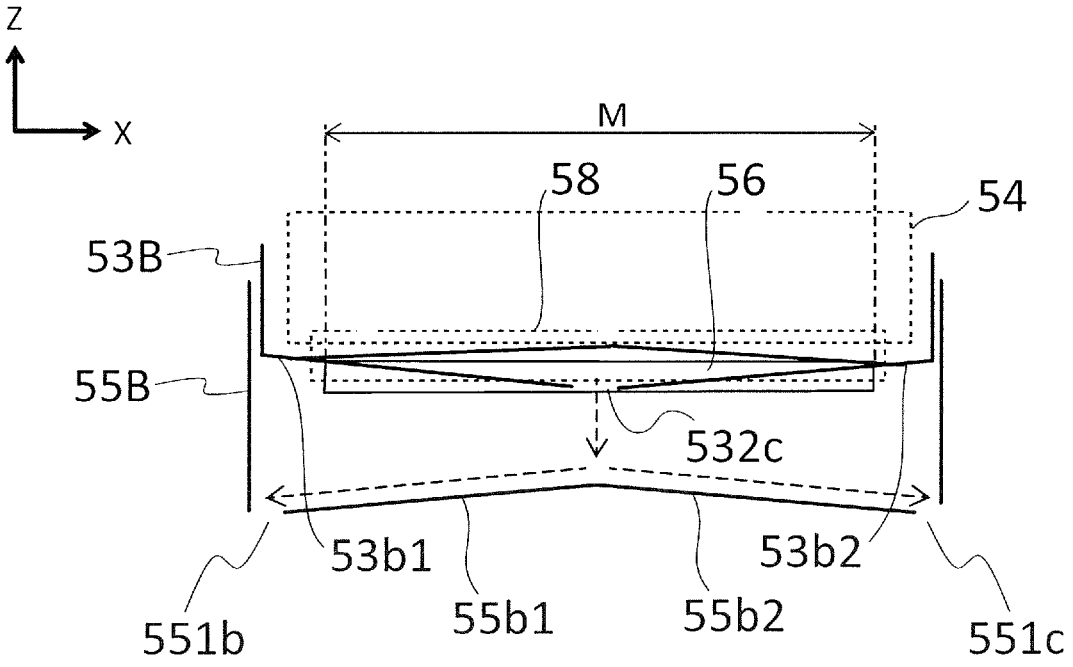
FIG. 6 is a schematic diagram illustrating a developing apparatus according to a third embodiment in a direction orthogonal to the rotational axis direction.

As illustrated in FIG. 6, a bottom surface of a developer storage tank 53B includes a fifth inclined surface 53*b*1 serving as a fifth inclined portion that is inclined downward from one portion of the developer storage tank 53B toward a center portion in the rotational axis direction, i.e., direction X in the drawing, of the developing roller 54. It further includes a seventh inclined surface 53*b*2 serving as a seventh inclined portion that is inclined downward from the other one of the end portions of the developer storage tank 53B toward the center portion. In this case, the bottom surface of the developer storage tank 53B is formed in an approximately V-shape by the fifth inclined surface 53*b*1 and the seventh inclined surface 53*b*2, so that liquid developer in the developer storage tank 53B is flown by gravity along the fifth inclined surface 53*b*1 and the seventh inclined surface 53*b*2 to a center portion corresponding to an approximately V-shaped valley portion. Therefore, according to the present embodiment, a fourth discharge port 532*c* serving as a discharge port of the developer storage tank 53B is formed at the approximately V-shaped valley portion.

Meanwhile, a bottom surface of a developer container 55B includes a sixth inclined surface 55*b*1 serving as a sixth inclined portion that overlaps with the fifth inclined surface 53*b*1 when viewed in the vertical direction in the rotational axis direction, i.e., direction X in the drawing, of the developing roller 54, and an eighth inclined surface 55*b*2 serving as an eighth inclined portion that overlaps with the seventh inclined surface 53*b*2. That is, the sixth inclined surface 55*b*1 is inclined downward from a center portion toward one of end portions of the developer container 55B, and the eighth inclined surface 55*b*2 is inclined downward from the center portion toward the other one of the end portions of the developer container 55B. In this case, the bottom surface of the developer container 55B is formed in an inverted V-shape by the sixth inclined surface 55*b*1 and the eighth inclined surface 55*b*2, so that liquid developer in the developer container 55B is flown by gravity from the center portion towards both end sides in the developer container 55B. Therefore, according to the present embodiment, a fifth discharge port 551*b* and a sixth discharge port 551*c* serving as discharge ports of the developer container 55B are formed on either ends of the developer container 55B.

According to the present embodiment, the fifth discharge port 551*b* and the sixth discharge port 551*c* are formed on the outer side of the abutment area M between the cleaning blade 56 and the cleaning roller 58 in the rotational axis direction, i.e., direction X in the drawing, of the developing roller 54. Further, the amount of discharge of liquid developer from the fifth discharge port 551*b* and the sixth discharge port 551*c* is set to be approximately 0.5 L/min in total. The inclination angle of the respective fifth, sixth, seventh and eighth inclined surfaces mentioned above should be set to an angle (such as 1.1°) determined based on a sufficient inclination angle (such as 0.5°) for flowing liquid developer having a viscosity of 30 cP, plus tolerance.

As described, also according to the third embodiment, liquid developer discharged through the fourth discharge port 532*c* of the developer storage tank 53B is flown toward the fifth discharge port 551*b* and the sixth discharge port 551*c* by inclination in the developer container 55B. Similarly, according to the present embodiment, the fourth discharge port 532*c* is formed to interpose the abutment area M between the cleaning blade 56 and the cleaning roller 58 with the fifth discharge port 551*b* and the sixth discharge port 551*c*. Therefore, liquid developer discharged through the fourth discharge port 532*c* washes away toner accumulated on the bottom surface (55*b*1 and 55*b*2) of the developer container 55B. Therefore, even according to the third embodiment, a similar effect as the first embodiment of reducing the toner density of liquid developer remaining in the developer container 55B after stopping supply of liquid developer by a simple configuration can be achieved.

INDUSTRIAL APPLICABILITY

The present developing apparatus can be adopted in an image forming apparatus such as a copying machine, a printer, a facsimile or a multifunction machine having a plurality of these functions, and specifically, it is preferably adopted in those using liquid developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A developing apparatus comprising:

a developer bearing member configured to bear liquid developer including toner and carrier liquid and rotate;

a developer container configured to collect and store liquid developer borne on the developer bearing member; and a storage tank arranged within the developer container and configured to store liquid developer to be supplied to the developer bearing member, wherein the storage tank comprises a first bottom surface comprising an inclined portion that is inclined downward with respect to a horizontal direction in a rotational axis direction of the developer bearing member, and a discharge port arranged on a lower end of the inclined portion of the first bottom surface and configured to discharge liquid developer by gravity into the developer container, and the developer container comprises a second bottom surface comprising an inclined portion that is inclined downward with respect to the horizontal direction toward an opposite direction as the inclined portion of the first bottom surface in the rotational axis direction of the developer bearing member, and a discharge port arranged on a lower end of the inclined portion of the second bottom surface and configured to discharge liquid developer to an exterior of the developer container.

2. The developing apparatus according to claim 1, wherein the inclined portion of the first bottom surface of the storage tank is arranged such that at least a part thereof is overlapped with the inclined portion of the second bottom surface of the developer container in a direction orthogonal to the rotational axis direction of the developer bearing member when viewed in a vertical direction.

3. The developing apparatus according to claim 1, wherein the inclined portion of the first bottom surface of the storage tank is arranged such that at least a part thereof is overlapped with the inclined portion of the second bottom surface of the developer container in the rotational axis direction of the developer bearing member when viewed in a vertical direction.

4. The developing apparatus according to claim 1, wherein the inclined portion of the first bottom surface is inclined downward from one end portion to the other end portion of the first bottom surface in the rotational axis direction of the developer bearing member, and the inclined portion of the second bottom surface is inclined downward from the other end portion to one end portion of the second bottom surface in the rotational axis direction of the developer bearing member.

5. The developing apparatus according to claim 1, wherein the discharge port of the storage tank is a first discharge port and the discharge port of the developer container is a second discharge port, the inclined portion of the first bottom surface is a first inclined portion that is inclined downward from a center portion of the first bottom surface toward one end portion of the first bottom surface in the rotational axis direction of the developer bearing member, and the inclined portion of the second bottom surface is a second inclined portion that is inclined downward from one end portion of the second bottom surface toward the second discharge port in the rotational axis direction of the developer bearing member, the storage tank comprises a third inclined portion that is provided on the first bottom surface and inclined downward from the center portion toward the other end portion of the first bottom surface in the rotational axis direction of the developer bearing member, and a third discharge port provided on a lower end of the third inclined portion configured to discharge liquid developer by gravity into the developer container, the developer container comprises a fourth inclined portion that is provided on the second bottom surface and inclined downward from the other end portion of the second bottom surface toward the second discharge port, the first inclined portion and the second inclined portion are at least partially overlapped when viewed in a vertical direction, and the third inclined portion and the fourth inclined portion are at least partially overlapped when viewed in a vertical direction.

6. The developing apparatus according to claim 1, wherein the discharge port of the storage tank is a fourth discharge port and the discharge port of the developer container is a fifth discharge port, the inclined portion of the first bottom surface is a fifth inclined portion that is inclined downward from one end portion of the first bottom surface toward the fourth discharge port in the rotational axis direction of the developer bearing member, and the inclined portion of the second bottom surface is a sixth inclined portion that is inclined downward from a position below the fourth discharge port of the developer container toward the one end portion of the second bottom surface in the rotational axis direction of the developer bearing member, the storage tank comprises a seventh inclined portion that is provided on the first bottom surface and inclined downward from the other end portion toward the fourth discharge port in the rotational axis direction of the developer bearing member, the developer container comprises an eighth inclined portion that is provided on the second bottom surface and inclined downward from the position below the fourth discharge port of the developer container toward the other end portion of the second bottom surface, and a sixth discharge port provided on a lower end of the eighth inclined portion and configured to discharge liquid developer by gravity to an exterior of the developer container, and the fifth inclined portion and the sixth inclined portion are at least partially overlapped when viewed in a vertical direction, and the seventh inclined portion and the eighth inclined portion.

7. The developing apparatus according to claim 1, wherein the second bottom surface is inclined downward with respect to a horizontal direction from one end of the developer container toward a center portion in the direction orthogonal to the rotational axis direction of the developer bearing member.

8. The developing apparatus according to claim 1, further comprising:

a collecting member arranged within the developer container and configured to collect toner electrically from liquid developer borne on the developer bearing member; and a removing member configured to abut against the collecting member along the rotational axis direction of the developer bearing member to remove toner from the collecting member, wherein the removing member is arranged such that a leading edge portion on a side opposite from a side abutting against the collecting member is positioned between the discharge port of the storage tank and the discharge port of the developer container in a direction orthogonal to the rotational axis direction of the developer bearing member.

9. The developing apparatus according to claim 1, wherein an opening area of the discharge port of the storage tank is smaller than an opening area of the discharge port of the developer container.

* * * * *